US012378954B2

(12) United States Patent
Khayyat

(10) Patent No.: US 12,378,954 B2
(45) Date of Patent: Aug. 5, 2025

(54) PROCESS PUMPS AND RELATED METHODS OF TREATING A PROCESS LINE

(71) Applicant: Saudi Arabian Oil Company, Dhahran (SA)

(72) Inventor: Omar Wadea Mohammed Khayyat, Al Jubail (SA)

(73) Assignee: Saudi Arabian Oil Company, Dhahran (SA)

( * ) Notice: Subject to any disclaimer, the term of this patent is extended or adjusted under 35 U.S.C. 154(b) by 203 days.

(21) Appl. No.: 17/937,687

(22) Filed: Oct. 3, 2022

(65) Prior Publication Data

US 2024/0110552 A1 Apr. 4, 2024

(51) Int. Cl.

| | |
|---|---|
| ***F04B 9/113*** | (2006.01) |
| ***C10G 29/04*** | (2006.01) |
| ***E21B 43/267*** | (2006.01) |
| ***F04B 5/02*** | (2006.01) |

(52) U.S. Cl.

CPC ..... *F04B 9/113* (2013.01); *C10G 29/04* (2013.01); *E21B 43/267* (2013.01); *F04B 5/02* (2013.01)

(58) Field of Classification Search

CPC ..... C10G 29/04; E21B 43/267; F04B 5/02; F04B 9/113

See application file for complete search history.

(56) References Cited

U.S. PATENT DOCUMENTS

| | | | |
|---|---|---|---|
| 4,558,715 | A | 12/1985 | Walton et al. |
| 5,195,879 | A | 3/1993 | Reese et al. |
| 9,261,087 | B2 | 2/2016 | Kristola et al. |
| 2015/0078942 | A1 | 3/2015 | Singer et al. |

FOREIGN PATENT DOCUMENTS

| | | | | |
|---|---|---|---|---|
| CA | 02637715 | * | 8/2009 | |
| CA | 2637715 | A1 * | 8/2009 | ..... F01L 25/06 |
| WO | WO0175304 | * | 10/2001 | |
| WO | WO-0175304 | A1 * | 10/2001 | ..... F04B 17/042 |

OTHER PUBLICATIONS

SAIP Examination Report in Saudi Arabian Appln. No. 123450417, dated Nov. 10, 2024, 16 pages (with English translation).

* cited by examiner

*Primary Examiner* — Prem C Singh
*Assistant Examiner* — Brandi M Doyle
(74) *Attorney, Agent, or Firm* — Fish & Richardson P.C.

(57) ABSTRACT

A method of treating a fluid within a process line includes flowing a treatment chemical and a first volume of the fluid into an injection chamber of a process pump, exerting an upward force on a lower cylinder of a piston of the process pump with a mixture of the treatment chemical and the first volume of the fluid within the injection chamber, exerting a downward force on an upper cylinder of the piston with a second volume of the fluid, and transmitting the downward force to the lower cylinder of the piston to force the mixture out of the injection chamber and into the process line.

11 Claims, 6 Drawing Sheets

PROCESS PUMPS AND RELATED METHODS OF TREATING A PROCESS LINE

TECHNICAL FIELD

This disclosure relates to dual-cylinder piston pumps and related methods of chemically treating a fluid within a process line.

BACKGROUND

Hydrocarbon operations facilities includes multiple chemical injection skids for effecting process treatment requirements. Such skids consume a significant amount of electrical energy over the course of carrying out treatment processes. Options for chemical injection include manual injection processes and pump-based injection processes. These conventional processes come with several disadvantages, such as high expenses of pump injection processes that are fully dependent on electrical energy sources and a low effectiveness of manual injection processes as a result of lengthy set-up processes and operator inefficiencies.

SUMMARY

This disclosure relates to dual-cylinder piston pumps and related methods of hydraulically operating such a pump to chemically treat a fluid within a process line. The pump can be operated without an electric motor and thereby operates with a relatively low-energy consumption.

In one aspect, a method of treating a fluid within a process line includes flowing a treatment chemical and a first volume of the fluid into an injection chamber of a process pump, exerting an upward force on a lower cylinder of a piston of the process pump with a mixture of the treatment chemical and the first volume of the fluid within the injection chamber, exerting a downward force on an upper cylinder of the piston with a second volume of the fluid, and transmitting the downward force to the lower cylinder of the piston to force the mixture out of the injection chamber and into the process line.

Embodiments may provide one or more of the following features.

In some embodiments, the method further includes forcing a third volume of the fluid within the pumping chamber into a relief line and flowing the third volume of fluid into an outlet line.

In some embodiments, the method further includes flowing the second volume of fluid into the pumping chamber.

In some embodiments, the method further includes lengthening a positioning spring attached to the upper cylinder from a collapsed configuration to an extended configuration.

In some embodiments, the method further includes reducing an upper volume of an upper pressure transmission chamber adjacent the upper cylinder.

In some embodiments, the method further includes increasing a lower volume of a lower pressure transmission chamber adjacent the lower cylinder.

In some embodiments, the method further includes flowing a pressure transmission fluid from the upper transmission chamber to the lower transmission chamber.

In some embodiments, the pressure transmission fluid includes oil.

In some embodiments, the method further includes automatically actuating two or more valves that are in fluid communication with the process pump.

In some embodiments, the method further includes simultaneously actuating two or more valves that are in fluid communication with the process pump.

In another aspect, a fluid processing system includes a process pump. The process pump includes a housing including an upper chamber wall and a lower chamber wall and a piston that is movable within the housing. The piston includes a shaft, a lower cylinder fixed to a lower end of the shaft and disposed within the lower chamber wall, and an upper cylinder slidably coupled to an upper end of the shaft and disposed within the upper chamber wall.

Embodiments may provide one or more of the following features.

In some embodiments, the process pump further includes a positioning spring that is attached to the upper end of the shaft and to an upper surface of the upper cylinder.

In some embodiments, the positioning spring is biased to a collapsed configuration and is configured to lengthen to an extended configuration in response to a downward force directed on the upper cylinder.

In some embodiments, the upper cylinder and the lower chamber wall together form an upper pressure transmission chamber, and the lower chamber wall and the lower cylinder together form a lower pressure transmission chamber.

In some embodiments, the process pump further includes a conduit that extends between the upper and lower pressure transmission chambers In some embodiments, the upper and lower pressure transmission chambers contain a pressure transmission fluid.

In some embodiments, the fluid processing system further includes a chemical tank, a process line containing a fluid to be treated by the process pump, and a fluid circuit by which the chemical tank fluidly communicates with the process pump and by which the process pump fluidly communicates with the process line.

In some embodiments, the fluid processing system further includes multiple automated valves positioned across the fluid circuit.

In some embodiments, the process pump is configured to pump a dose of a treatment chemical from the chemical tank through the fluid circuit and into the process line. In another aspect, a process pump includes a housing including an upper chamber wall and a lower chamber wall and a piston that is movable within the housing. The piston includes a shaft, a lower cylinder fixed to a lower end of the shaft and disposed within the lower chamber wall, and an upper cylinder slidably coupled to an upper end of the shaft and disposed within the upper chamber wall.

The details of one or more embodiments are set forth in the accompanying drawings and description. Other features, aspects, and advantages of the embodiments will become apparent from the description, drawings, and claims.

DETAILED DESCRIPTION

Figure 1:
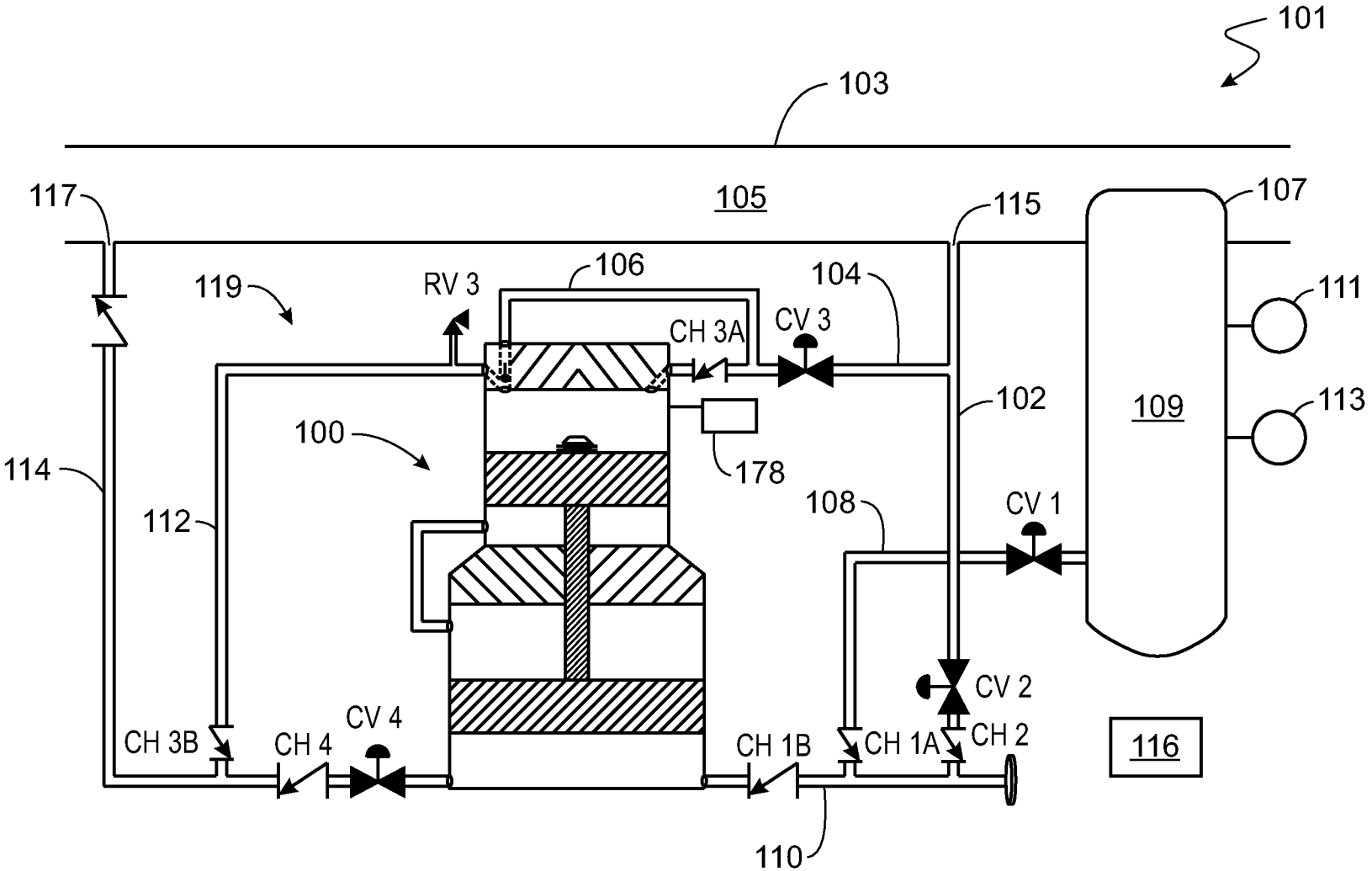
FIG. 1 is a diagram of a fluid processing system including a dual-cylinder piston pump.

FIG. 1 illustrates an example fluid processing system 101 (e.g., a chemical injection skid) within an oil and gas processing facility. The fluid processing system 101 includes a process line 103 through which a fluid 105 (e.g., industrial water) flows to various processing stations within the processing facility, a chemical tank 107 that stores a treatment chemical 109, and a process pump 100 that pumps the treatment chemical 109 into the process line 103 for treating the fluid 105. Example treatment chemicals 109 that may be stored in the chemical tank 107 include hypochlorite and other chemicals. The chemical tank 107 is equipped with a level indicator 111 that monitors a level of the treatment chemical 109 within the chemical tank 107 and a gauge 113 that monitors a pressure of the treatment chemical 109.

The fluid processing system 101 also includes several additional fluid lines by which the fluid 105 and the chemical 109 are circulated throughout a fluid circuit 119. The fluid lines include an inlet line 102, an inlet line 104, a pressurization line 106, a chemical line 108, a chemical line 110, a relief line 112, and an outlet line 114. The fluid processing system 101 further includes several control valves (e.g., dosing valves CV1, CV2, CV3, and CV4) that are equipped with respective pressure and flow sensors, several check valves (e.g., one-way valves CH1A, CH1B, CH2, CH3A, CH3B, and CH4), and a relief valve RV3. The fluid processing system 101 accordingly includes a controller 116 that controls opening and closing of the various valves in a synchronized manner to achieve a system logic based on signals received from the pressure sensors.

Figure 2:
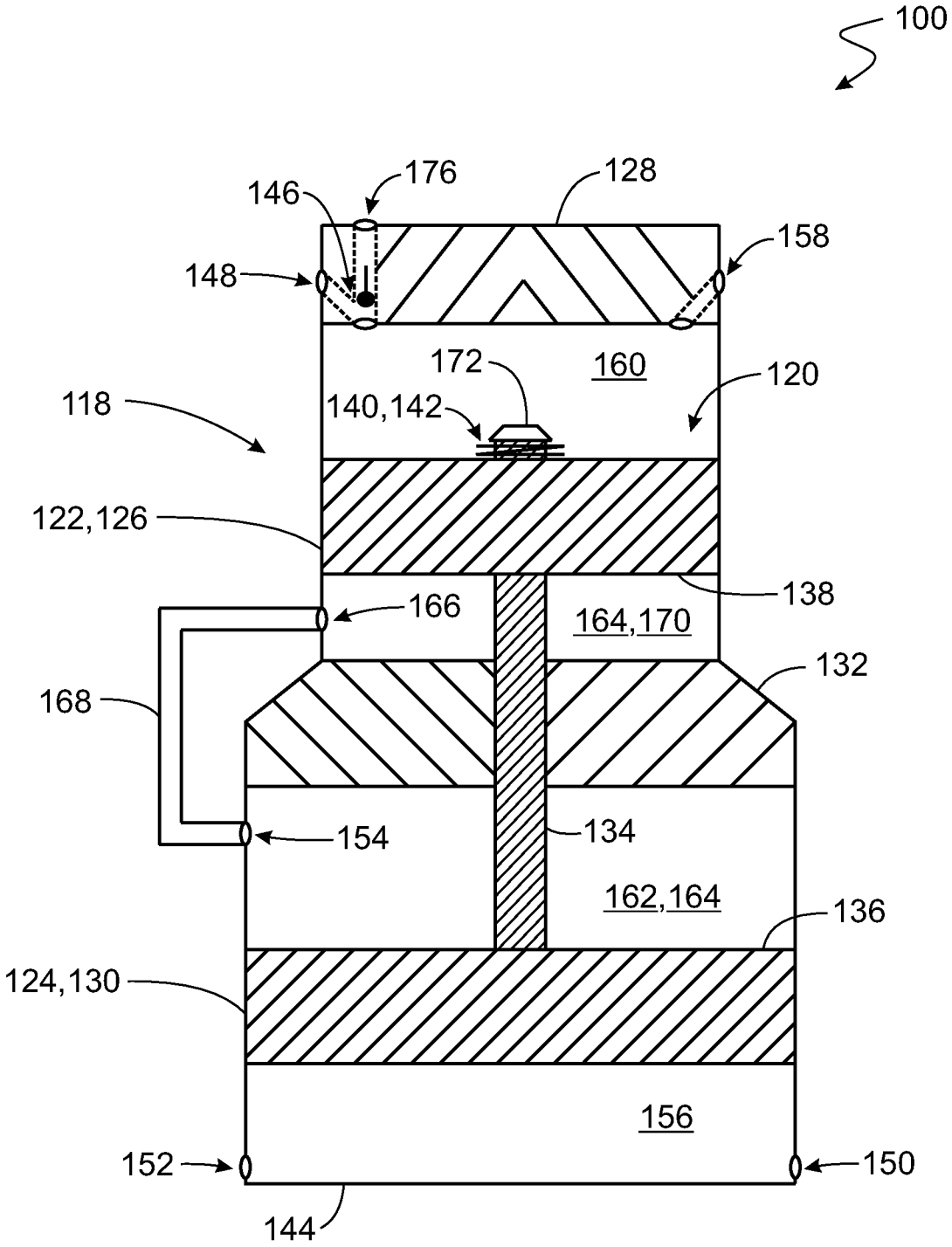
FIG. 2 is a cross-sectional view of the pump of FIG. 1.

Referring to FIG. 2, the process pump 100 is designed to efficiently pump (e.g., dose) the treatment chemical 109 into the process line 103 without an associated electrical motor and any power that would otherwise be delivered from such a motor. The process pump 100 operates automatically as a result of actions of the control valves. The process pump 100 includes a housing 118 and a dual-cylinder piston 120 positioned within the housing 118. The housing 118 includes an upper chamber wall 122 and a lower chamber wall 124. The upper chamber wall 122 includes an upper side wall 126 and an upper ceiling wall 128. The lower chamber wall 124 includes a lower side wall 130, a lower ceiling wall 132, and a bottom wall 144.

The piston 120 includes a shaft 134, a lower cylinder 136 that is fixed to a lower end of the shaft 134, an upper cylinder 138 that is slidably coupled to an upper end 140 of the shaft 134, and a positioning spring 142 located at the upper end 140. The process pump 100 further includes a plug valve 146, a pressure relief port 148, an inlet port 158, and an inlet port 176 located within the upper ceiling wall 128. The shaft 134 extends through an opening 144 in the lower ceiling wall 132. The lower side wall 130 includes an inlet port 150, an outlet port 152, and a lower pressure transmission port 154.

The lower cylinder 136, the lower side wall 130, and the bottom wall 144 together define an injection chamber 156 that receives the treatment chemical 109 and the fluid 105. The upper cylinder 138, the upper side wall 126, and the upper ceiling wall 128 together define a pumping chamber 160 that receives fluid 105 from the inlet line 104 to force the piston 120 in a downward direction. The positioning spring 142 is attached to a stopper 172 at the upper end 140 of shaft 134 and to an upper surface of the upper cylinder 138. Therefore, a fully extended length of the positioning spring 142 defines a total distance by which the upper cylinder 138 can move downward from the upper end 140 of the shaft 134. The process pump 100 is equipped with a position sensor 178 that monitors a position of the upper cylinder 138 during delivery of a chemical dose to the injection chamber 156.

The lower side wall 130, the lower cylinder 136, and the lower ceiling wall 132 together define a lower pressure transmission chamber 162 containing a pressure transmission fluid 164 (e.g., transmission oil). The upper side wall 126, the upper cylinder 138, and the lower ceiling wall 132 together define an upper pressure transmission chamber 170 containing the pressure transmission fluid 164 (e.g., transmission oil). Accordingly, the upper side wall 126 includes an upper pressure transmission port 166. A pressure transmission conduit 168 extends between the lower and upper pressure transmission ports 154, 166. The pressure transmission conduit 168 is available to collect an overflow of pressure transmission fluid 164 to accommodate a reduction in total volume of the lower and upper pressure transmission chambers 162, 170.

Figure 3:
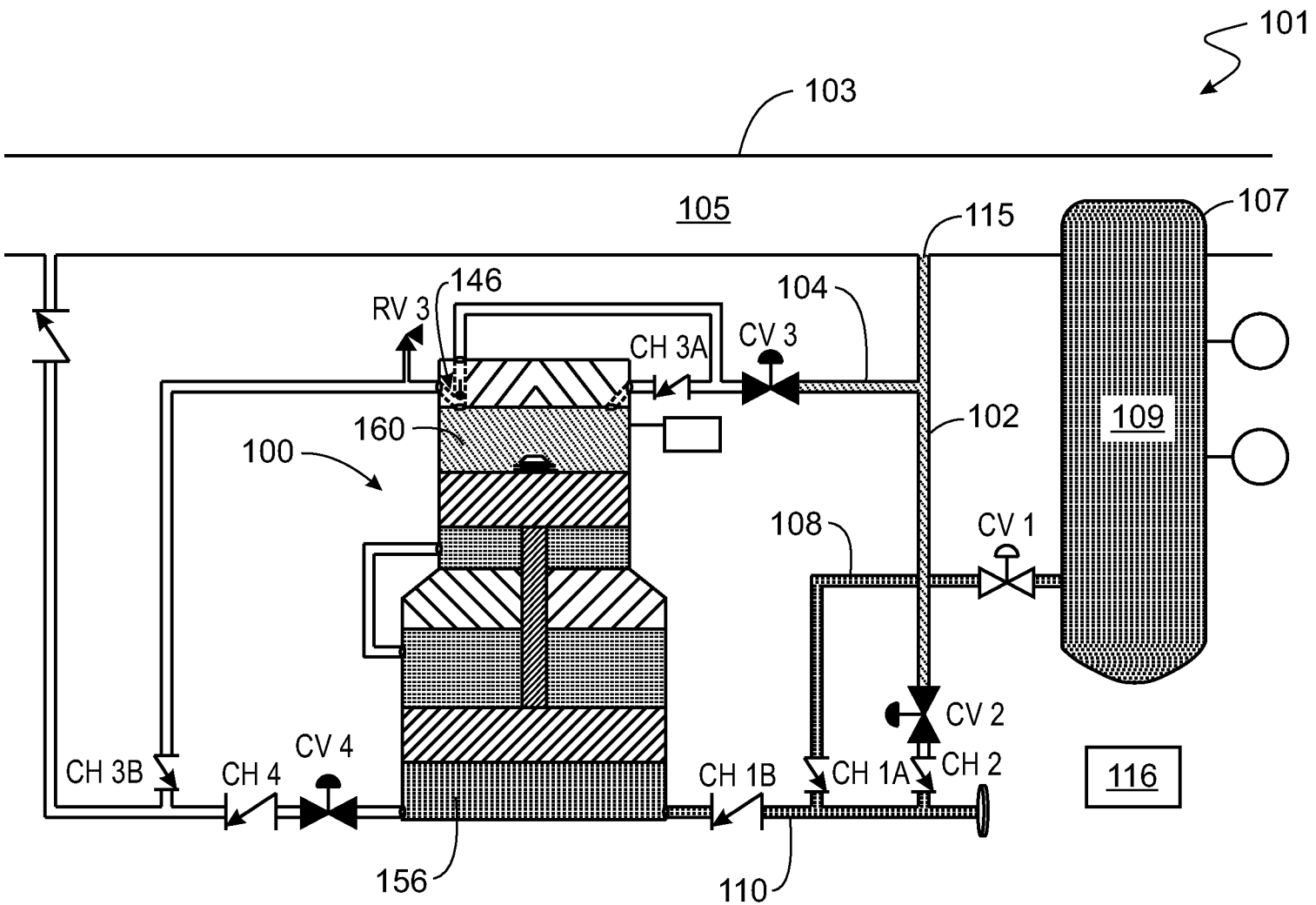
FIG. 3 is illustrates a first stage of a process for treating a fluid within a process line of the system of FIG. 1 with the pump of FIG. 1.
Figure 4:
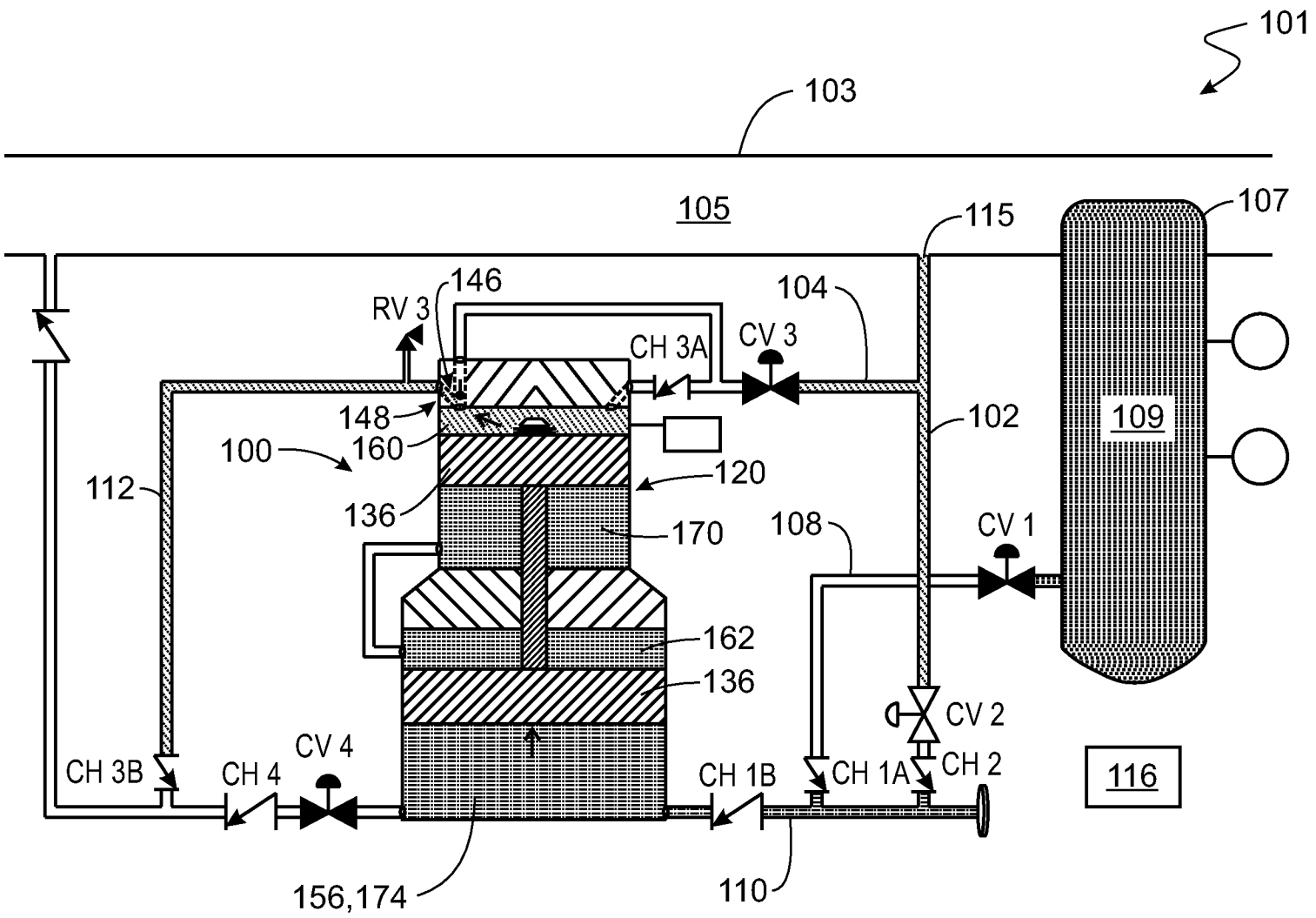
FIG. 4 is illustrates a second stage of the process of FIG. 2.
Figure 5:
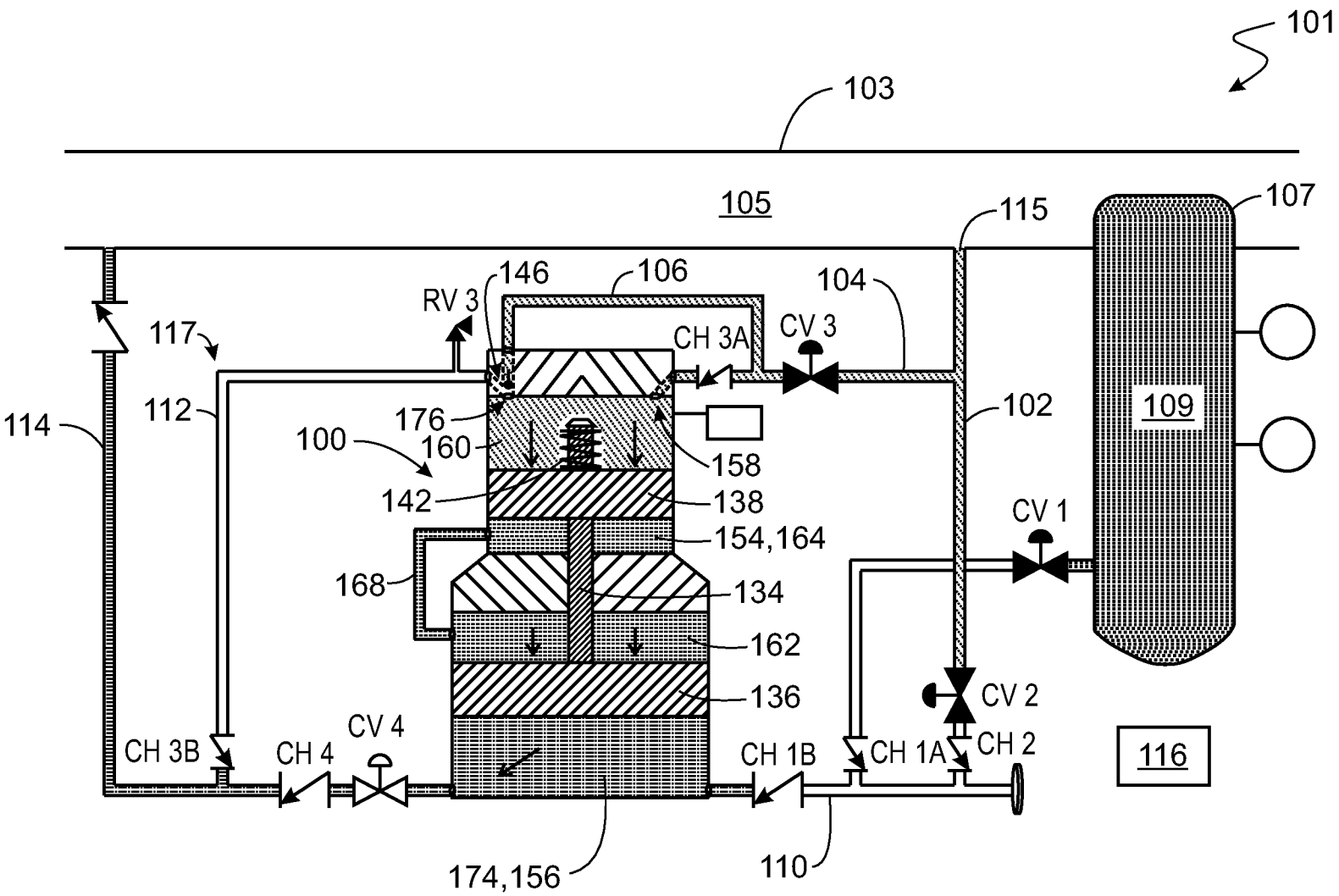
FIG. 5 is illustrates a third stage of the process of FIG. 2.

FIGS. 3-5 sequentially illustrate a smooth, cyclic process for treating the fluid 105 within the process line 103 (e.g., a chemical treatment cycle) by operating the process pump 100. FIG. 3 illustrates a first stage of the process. During the first stage, a predetermined (e.g., preset) volume of fluid 105 flows into the inlet lines 102, 104 from the process line 103 through a fluid circuit inlet 115. The fluid 105 flows to CV2 and CV3, which are closed during the first stage. Additionally, a predetermined volume (e.g., a preset dose) of treatment chemical 109 flows into the chemical lines 108, 110 from the chemical tank 107 through CV1, CH1A, and CH1B, which are open during the first stage. The treatment chemical 109 flows further into the injection chamber 156 and to CV4, which is closed during the first stage. The plug valve 146 is also closed during the first stage, which prevents fluid 105 within the pumping chamber 160 from flowing out of the pumping chamber 160 during the first stage.

FIG. 4 illustrates a second stage of the process. During the second stage, CV1 closes, CV2 opens, the plug valve 146 opens, and RV3 opens simultaneously (e.g., synchronously) upon receiving respective instructions from the controller 116. Accordingly, the fluid 105 in the inlet line 102 and the treatment chemical 109 in the chemical line 108 flow through CV2 and CH2 and CH1A, respectively, into the chemical line 110, through CH1B, and into the injection chamber 156. Within the injection chamber 156, a mixture 174 of the treatment chemical 109 and the fluid 105 (e.g., having a volume larger than that of the initial dose of the treatment chemical 109 alone) exerts an upward force on a lower surface of the lower cylinder 136. Because a fluid pressure within the pressure transmission chambers 162, 170 and the pumping chamber 160 are all substantially equal, the upward directed force causes the entire piston 120 to move upward in a fixed configuration of the lower and upper cylinders 136, 138.

Upward movement of the piston 120 increases a volume of the injection chamber 156 and decreases a volume of the pumping chamber 160 by substantially the same amount. The decreased volume of the pumping chamber 160 forces the fluid 105 to flow out of the pumping chamber 160, through the pressure relief port 148 and into the relief line 112. The fluid 105 flows to CH3B, which is closed during the second stage. Volumes of the lower and upper pressure transmission chambers 162, 170 remain substantially unchanged during the second stage of the process.

FIG. 5 illustrates a third stage of the process. During the third stage, CV2 closes, CH1B closes, CV3 opens, the plug valve 146 closes, the inlet ports 158, 176 open, CH3B opens, and CV4 opens simultaneously (e.g., synchronously) upon receiving respective instructions from the controller 116. Accordingly, fluid 105 in the inlet lines 102, 104 flows through the inlet port 158, the pressurization line 106, and the inlet port 176 into the pumping chamber 160. The fluid 105 is confined in the pumping chamber 160 such that a fluid pressure within the pumping chamber 160 increases and the fluid 105 exerts a downward force on an upper surface of the upper cylinder 138.

The force causes the upper cylinder 138 to slide downward along the shaft 134 from the upper end 140 of the shaft 134 by the total length of the positioning spring 142 in its fully extended configuration. Thus, downward movement of the upper cylinder 138 causes the positioning spring 142 to extend from a collapsed, biased configuration (e.g., shown in FIGS. 3 and 4) to the fully extended configuration (e.g., shown in FIG. 5). Downward movement of the upper cylinder 138 accordingly increases the volume of the pumping chamber 160 and decreases volume of the upper pressure transmission chamber 154. Compression of the upper pressure transmission chamber 154 causes the pressure transmission fluid 164 within the upper pressure transmission chamber 154 to overflow into the pressure transmission conduit 168 and further into the lower transmission chamber 162. This flow increases the volume of the lower pressure transmission chamber 162 to and accordingly exerts a downward force on an upper surface of the lower cylinder 136.

The downward force on the lower cylinder 136 forces the mixture 174 out of the injection chamber 156, through CV4 and CH4, and into the outlet line 114. In this manner, the piston 120 operates like a plunger in response to dynamic pressures within the process pump 100. Fluid 105 in the relief line 112 also flows through CH3 into the outlet line 114. From the outlet line 114, the mixture 174 (e.g., including the treatment chemical 109) flows through the fluid circuit outlet 117 into the process line 103 to treat the fluid 105 in the process line 103.

The process may then be repeated as many times as necessary to achieve a desired level of chemical treatment within the process line 103 (e.g., a desired number or frequency of doses to the fluid 105 within the process line 103. Throughout the process, the level and the pressure of the treatment chemical 109 within the chemical tank 107 are respectively monitored by the level indicator 111 and the gauge 113 to ensure that the treatment chemical 109 remains at a substantially low pressure. In some embodiments, the pressure of the treatment chemical 109 within the chemical tank 107 is maintained between about 101.3 kilopascals (kPa) and about 344.8 Pa.

Utilizing hydraulic mechanical actuation of the process pump 100 avoids consumption of significant electrical power that would otherwise need to be produced by a motor to actuate a conventional treatment pump for dosing a process line with a chemical treatment. For example, carrying out the process illustrated in FIGS. 3-5 to divert a stream of fluid 105 from the process line 103 into the fluid circuit 119 effectively provides the process pump 100 with a self-renewing energy source. In this manner, a design and an implementation of the process pump 100 results in a significant reduction in the number of components needed to treat a process line and a related operational cost savings. Furthermore, eliminating power sources (e.g., such as a motor) correspondingly eliminates carbon emissions that would otherwise accompany the utilization of such power sources. Additionally, owing to an automated functioning of the process pump 100 provided by the control valves, human involvement in the chemical treatment is minimized and an efficiency of the chemical dosing is maximized.

Figure 6:
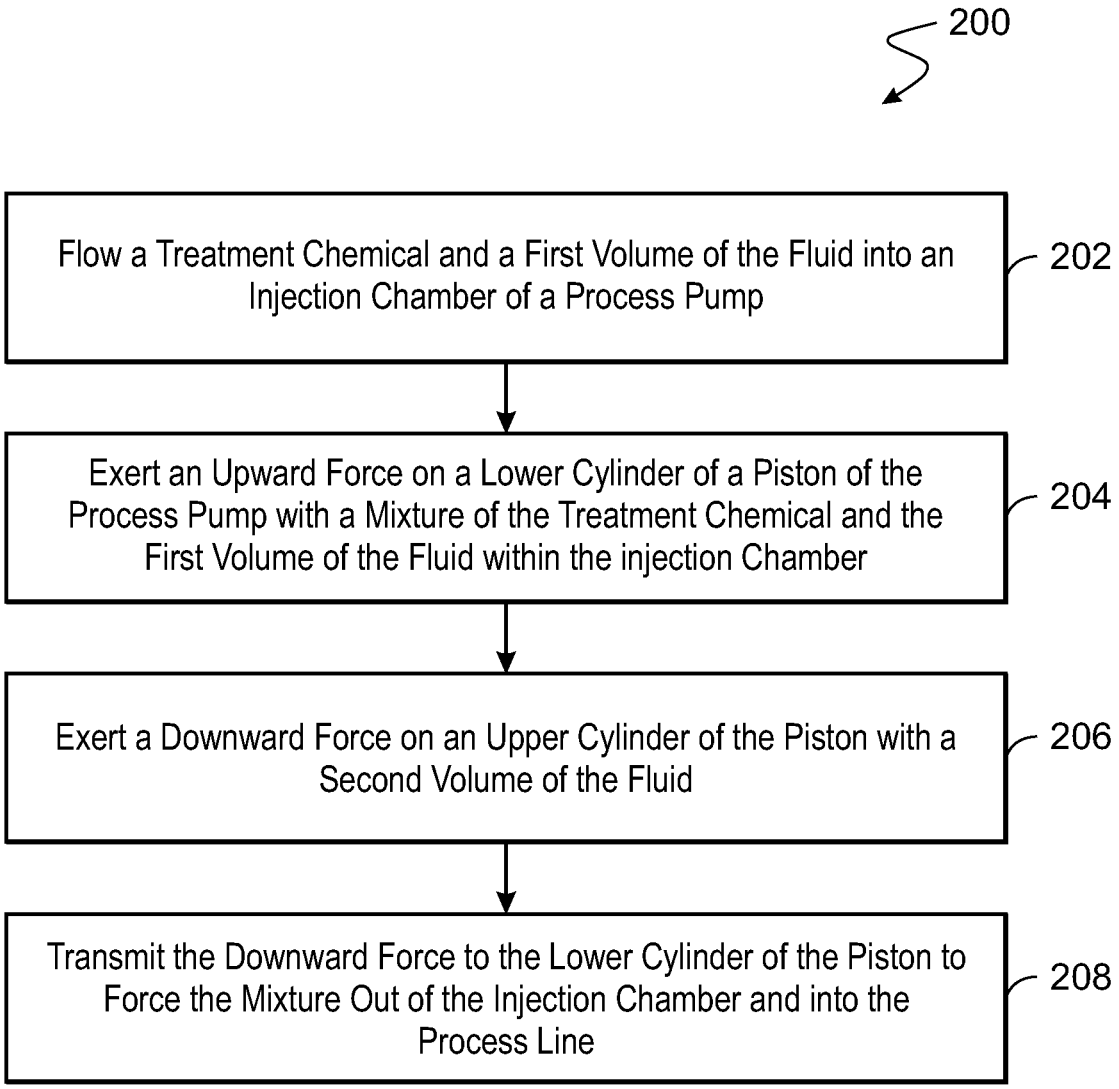
FIG. 6 is a flow chart illustrating an example method of treating a fluid within a process line of the system of FIG. 1 with the pump of FIG. 1.

FIG. 6 is a flow chart illustrating an example method 200 of treating a fluid (e.g., the fluid 105) within a process line (e.g., the process line 103). In some embodiments, the method 200 includes a step 202 for flowing a treatment chemical (e.g., the treatment chemical 109) and a first volume of the fluid into an injection chamber (e.g., the injection chamber 156) of a process pump (e.g., the process pump 100). In some embodiments, the method 200 includes a step 204 for exerting an upward force on a lower cylinder (e.g., the lower cylinder 136) of a piston (e.g., the piston 120) of the process pump with a mixture (e.g., the mixture 174) of the treatment chemical and the first volume of the fluid within the injection chamber.). In some embodiments, the method 200 includes a step 206 for exerting a downward force on an upper cylinder (e.g., the upper cylinder 138) of the piston with a second volume of the fluid. In some embodiments, the method 200 includes a step 208 for transmitting the downward force to the lower cylinder of the piston to force the mixture out of the injection chamber and into the process line.

While the fluid processing system 101 and the process pump 100 have been described and illustrated with respect to certain dimensions, sizes, shapes, arrangements, materials, and methods 200, in some embodiments, a system or a pump that is otherwise substantially similar in construction and function to the fluid processing system 101 or the process pump 100 may include one or more different dimensions, sizes, shapes, arrangements, configurations, and materials or may be utilized according to different methods.

Accordingly, other embodiments are also within the scope of the following claims.

What is claimed is:

1. A method of treating a fluid within a process line, the method comprising:

flowing a treatment chemical and a first volume of the fluid into an injection chamber of a process pump;

exerting an upward force on a lower cylinder of a piston of the process pump with a mixture of the treatment chemical and the first volume of the fluid within the injection chamber;

exerting a downward force on an upper cylinder of the piston with a second volume of the fluid within a pumping chamber, the upper cylinder being separate from and spaced axially apart from the lower cylinder;

while the downward force is exerted on the upper cylinder, lengthening a positioning spring attached to the upper cylinder from a collapsed configuration to an extended configuration; and transmitting the downward force to the lower cylinder of the piston to force the mixture out of the injection chamber and into the process line.

2. The method of claim 1, further comprising:

forcing a third volume of the fluid within the pumping chamber into a relief line; and flowing the third volume of fluid into an outlet line.

3. The method of claim 1, further comprising flowing the second volume of fluid into the pumping chamber.

4. The method of claim 1, wherein the positioning spring is attached to an upper surface of the upper cylinder, and wherein the positioning spring is located within the pumping chamber.

5. The method of claim 1, further comprising reducing an upper volume of an upper pressure transmission chamber adjacent the upper cylinder.

6. The method of claim 5, further comprising increasing a lower volume of a lower pressure transmission chamber adjacent the lower cylinder.

7. The method of claim 6, further comprising flowing a pressure transmission fluid from the upper transmission chamber to the lower transmission chamber through a conduit that extends directly from the upper transmission chamber to the lower pressure transmission chamber.

8. The method of claim 7, wherein the pressure transmission fluid comprises oil.

9. The method of claim 1, further comprising automatically actuating two or more valves that are in fluid communication with the process pump.

10. The method of claim 1, further comprising simultaneously actuating two or more valves that are in fluid communication with the process pump.

11. The method of claim 1, wherein the lower cylinder is located below the pumping chamber, and wherein the upper cylinder is located above the injection chamber.

* * * * *